US006025863A

United States Patent [19]

Nakajima et al.

[11] Patent Number: 6,025,863

[45] Date of Patent: Feb. 15, 2000

[54] LED HEAD FOR ILLUMINATING A SURFACE OF A PHOTOCONDUCTIVE BODY

[75] Inventors: Norio Nakajima; Yoshihisa Aikoh, both of Tokyo, Japan

[73] Assignee: Oki Data Corporation, Tokyo, Japan

[21] Appl. No.: 09/058,690

[22] Filed: Apr. 10, 1998

[30] Foreign Application Priority Data

Apr. 14, 1997 [JP] Japan ..... 9-095728

[51] Int. Cl.[7] ..... B41J 2/235

[52] U.S. Cl. ..... 347/238; 347/241; 347/242; 347/245

[58] Field of Search ..... 347/238, 245, 347/241, 242, 256, 257; 250/208.1; 257/99

[56] References Cited

U.S. PATENT DOCUMENTS

| | | | |
|---|---|---|---|
| 5,254,847 | 10/1993 | Hata et al. | 250/208.1 |
| 5,291,039 | 3/1994 | Ogata et al. | 257/99 |
| 5,403,102 | 4/1995 | Yokoyama | 347/238 |
| 5,808,718 | 9/1998 | Aikoh et al. | 347/238 |

*Primary Examiner*—N. Le
*Assistant Examiner*—Hai C. Pham
*Attorney, Agent, or Firm*—Akin, Gump, Strauss, Hauer & Feld, L.L.P.

[57] ABSTRACT

An LED head for illuminating a surface of a photoconductive body includes an LED circuit board, lens assembly (SLA), SLA holder, base, and engagement member. The LED circuit board has LED arrays mounted thereon. The lens assembly has an optical axis and focuses light emitted from the LED arrays on the surface of the photoconductive body. The SLA holder has two opposing walls to hold the lens assembly therebetween. One of the opposing walls has a first reference surface with which the optical axis of the lens assembly is in a predetermined positional relation and urges the lens assembly against the other of the opposing walls. The base houses the LED circuit board and the SLA holder therein. The base has a second reference surface such that the optical axis is placed in position with respect to the LED arrays when the second reference surface is in intimate contact with the first reference surface. An engagement member holds the holder and the base together so that the first and second reference surfaces are in intimate contact with each other.

5 Claims, 13 Drawing Sheets

LED HEAD FOR ILLUMINATING A SURFACE OF A PHOTOCONDUCTIVE BODY

BACKGROUND OF THE INVENTION

1. Field of the Invention

The present invention related to an LED head which is assembled into an electrophotographic printer and includes an optical lens assembly that focuses light emitted from LEDs of the LED head on the surface of a photoconductive drum.

2. Description of Conventional Art

With a conventional electrophotographic printer, an LED head incorporates a lens holder which receives an optical lens assembly therein and holds it in position with respect to the LEDs to accurately focus the images of the LEDs on the surface of a photoconductive drum. Accurately focusing the images of the LEDs on corresponding points of the photoconductive drum is one of the major factors that determines the print quality of an electrophotographic printer.

FIG. 17 is a cross sectional view of the conventional LED head. The LED circuit board 7 has a row of LED arrays 6 mounted thereon and longitudinally extends in a direction perpendicular to the page of FIG. 17. There is a lateral small gap between the edge of the LED circuit board 7 and the SLA holder 3. This gap is due to manufacturing errors. The SLA (selfoc lens array) 4 extends in a direction parallel to the row of the LED arrays 6. The SLA 4 is supported between two opposing walls 3*f* and 3*g* of an SLA holder 3 in a sandwiched relation, the two walls 3*f* and 3*g* extending in directions parallel to the row of the LED arrays 6. The wall 3*f* has a plurality of resilient members 3*d,* for example, three resilient members, that resiliently engage one side of the SLA 4 to urge the SLA 4 against the wall surface 3*e* of the other wall 3*g*. The SLA holder has projections 3*a* outwardly extending from the opposing walls 3*f* and 3*g,* which engage cutouts 2*a* (FIG. 4) in a base 2 when assembled to the base 2. The walls 3*g* and 3*f* has abutting surfaces 3*c,* respectively, which are in pressure contact with the top surface of the LED circuit 7 to firmly hold the LED circuit board 7 when the SLA holder 3 has been assembled into the a base 2, thereby accurately positioning the SLA 4 relative to the LED arrays 6.

FIG. 18 is a top view of the SLA 4 and SLA holder 3 when SLA 4 is urged by three resilient members 3*d* of the SLA holder 3.

When the SLA 4 is inserted between the two walls 3*f* and 3*g* of the SLA holder 3, the SLA holder 3 is deformed by forces F1, F2, and F3 applied by the three resilient members 3*d,* the two walls being pushed away from each other by the SLA 4 to extend in directions shown by arrows E and F. The deformation of the two walls in the directions shown by arrows E and F causes the SLA holder to deform at its lower end in a direction shown by an arrow G (FIG. 17). As a result, the opposing walls 3*f* and 3*g* are inclined. Such an inclination of the opposing walls 3*f* and 3*g* causes the SLA 4 to significantly deform as shown in FIG. 18. The deformation of the opposing walls 3*f* and 3*g* gives rise to the problem that the images of LED arrays 6 are not properly focused at corresponding points on the surface of the photoconductive drum 8.

The SLA holder 3 is fixed to the base 2 at longitudinal ends thereof and therefore the deformation of the SLA 4 near the longitudinal ends of the SLA holder 3 is not significant. Thus, the images of the LED arrays 6 near the longitudinal ends are formed on or very close to a point 8*a* of the photoconductive drum 8, the light being substantially normal to the surface of the photoconductive drum 8.

The SLA holder 3 is noticeably deformed by forces F1, F2, and F3 applied by the spring members 3*d,* so that the space 1*a* becomes wider toward a longitudinal middle thereof. The deformation of the SLA holder 3 causes the SLA 4 to tilt with respect to the LED arrays 6 when assembled into the LED head.

FIG. 19 shows the SLA 4 when it is not correctly positioned but inclined with respect to the LED arrays 6.

If the SLA 4 is correctly positioned, then optical axis of the SLA 4 is normal to the point 8*a* so that the image of the LED array 6 is formed at the point 8*a*. If the SLA 4 is inclined, then the optical axis of the SLA 4 aims at a point 8*b* where the SLA 4 focuses an image of a point 9 near the LED array 6 at a point 8*c* on the photoconductive drum 8, and the image of the LED array 6 is formed at the point 8*b*. It is to be noted that the images at 8*c* and 8*b* are behind the focal plane of the SLA 4 and is circumferentially away from the point 8*a*.

Thus, when the SLA 4 is correctly positioned, the images of all the LEDs on the LED arrays 6 are focused on the surface of the photoconductive drum 8 to form a line of points parallel to the axis of rotation of the drum 8. If the SLA 4 is inclined, then the line of images formed on the photoconductive drum 8 is curved so that the focused images are increasingly away from a line parallel to the axis of rotation of the photoconductive drum 8 toward the longitudinal middle of the photoconductive drum 8. Such deformation and/or inclination of the SLA 4 causes distorted images and is detrimental particularly in a tandem type color printer where registration of images of respective colors is of great importance. Misregistration of color images due to the deformation and/or inclination of the SLA 4 results in poor print quality.

SUMMARY OF THE INVENTION

An object of the invention is to provide a printer in which the lens assembly forms images of a plurality of LED arrays such that the images of the plurality of LED arrays, optical axis of the lens assembly, and the plurality of LED arrays are located in a same plane.

An LED head for illuminating a surface of a photoconductive body includes an LED circuit board, lens assembly (SLA), SLA holder, base, and engagement member. The LED circuit board has LED arrays mounted thereon. The lens assembly has an optical axis and focuses light emitted from the LED arrays on the surface of the photoconductive body. The SLA holder has two opposing walls to hold the lens assembly therebetween. One of the opposing walls has a first reference surface with which the optical axis of the lens assembly is in a predetermined positional relation and urges the lens assembly against the other of the opposing walls. The base houses the LED circuit board and the SLA holder therein. The base has a second reference surface such that the optical axis is placed in position with respect to the LED arrays when the second reference surface is in intimate contact with the first reference surface. An engagement member holds the holder and the base together so that the first and second reference surfaces are in intimate contact with each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

First embodiment

Figure 1:
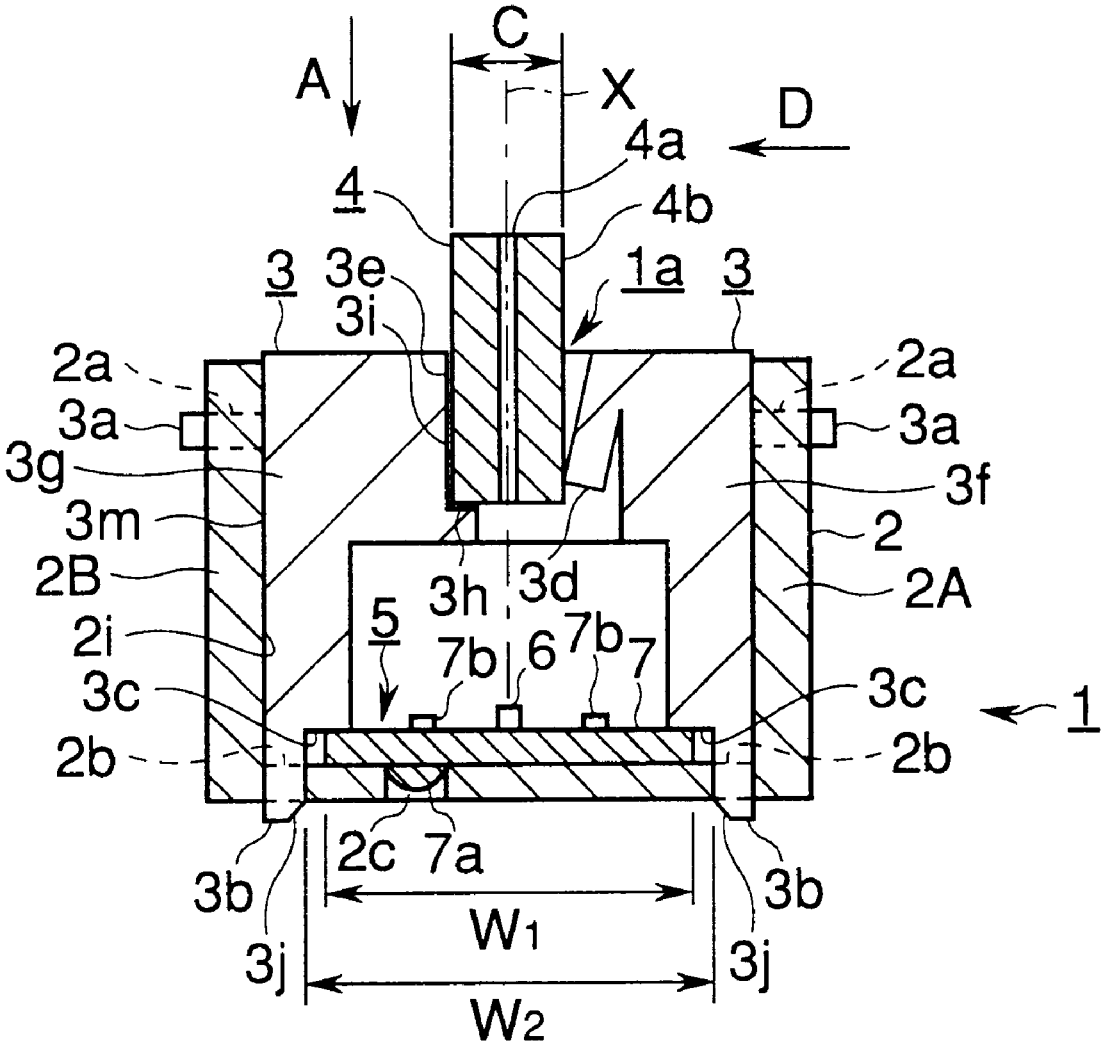
FIG. 1 is a cross-sectional view of an LED head 1.

A first embodiment will be described in detail with reference to the drawings. Like elements are given like reference numerals throughout the drawings.

FIG. 1 is a cross-sectional view of an LED head 1.

The LED head 1 includes a base 2, SLA (Selfoc lens array) holder 3 mounted on the base 2, SLA 4 held on the SLA holder 3, and LED array unit 5. The LED array unit 5 includes a printed circuit board 7, a row of LED arrays 6 mounted on the circuit board 7, and driver ICs 7*b* for driving the LED arrays 6.

Figure 2:
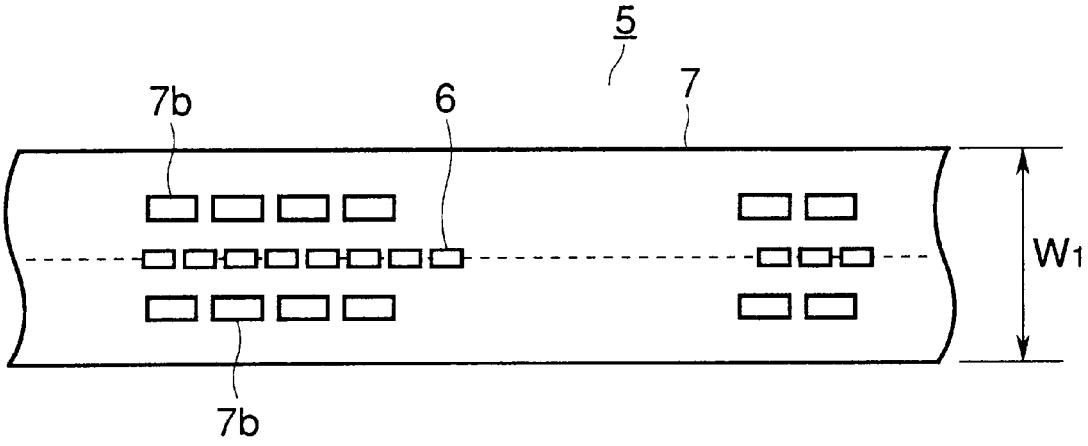
FIG. 2 is a fragmentary view of an LED array unit 5.

FIG. 2 is a fragmentary top view of the LED array unit 5.

The circuit board 7 takes the form of, for example, a glass epoxy board and longitudinally extends in directions perpendicular to the page of FIG. 1. The circuit board 7 has positioning projections 7*a* which project downward from the lower surface of the printed circuit board 7. A row of LED arrays 6 is mounted on the circuit boar 7. Each of the LED arrays 6 includes LEDs aligned in the direction of the row. The LED arrays 6 are mounted on the circuit board 7 such that their top surfaces lie in the same plane parallel to and at a predetermined height from the surface of the circuit board 7.

Figure 3:
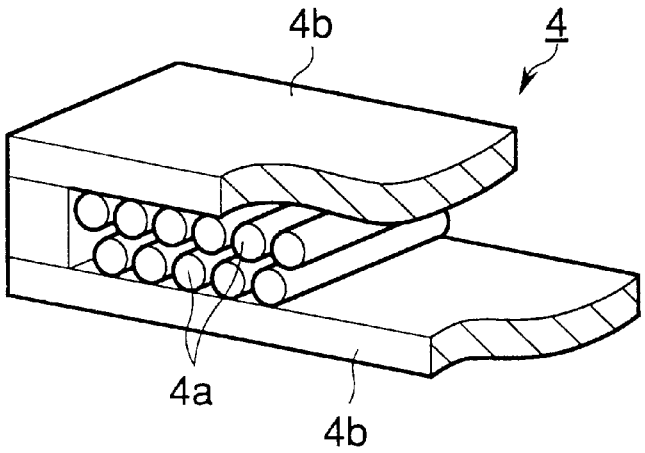
FIG. 3 is a fragmentary perspective view of the SLA 4.

FIG. 3 is a fragmentary perspective view of the SLA 4. The SLA 4 includes rod lenses 4*a* aligned in line between glass epoxy plates 4*b*. The SLA 4 longitudinally extends parallel to the row of LED arrays 6.

Referring again to FIG. 1, the SLA 4 is received at a stepped portion 3*h* of the SLA holder 3 and is urged in a direction shown by arrow D by the spring members 3*d* against the wall surface 3*e*. An optical axis of the SLA 4, shown in a dot-dash line, is normal to the printed circuit board 7 and is in line with the LEDs of the LED arrays 6.

The constructions of the base 2 and SLA holder 3 will be described with reference to FIGS. 4, 5, and 6.

Figure 4:
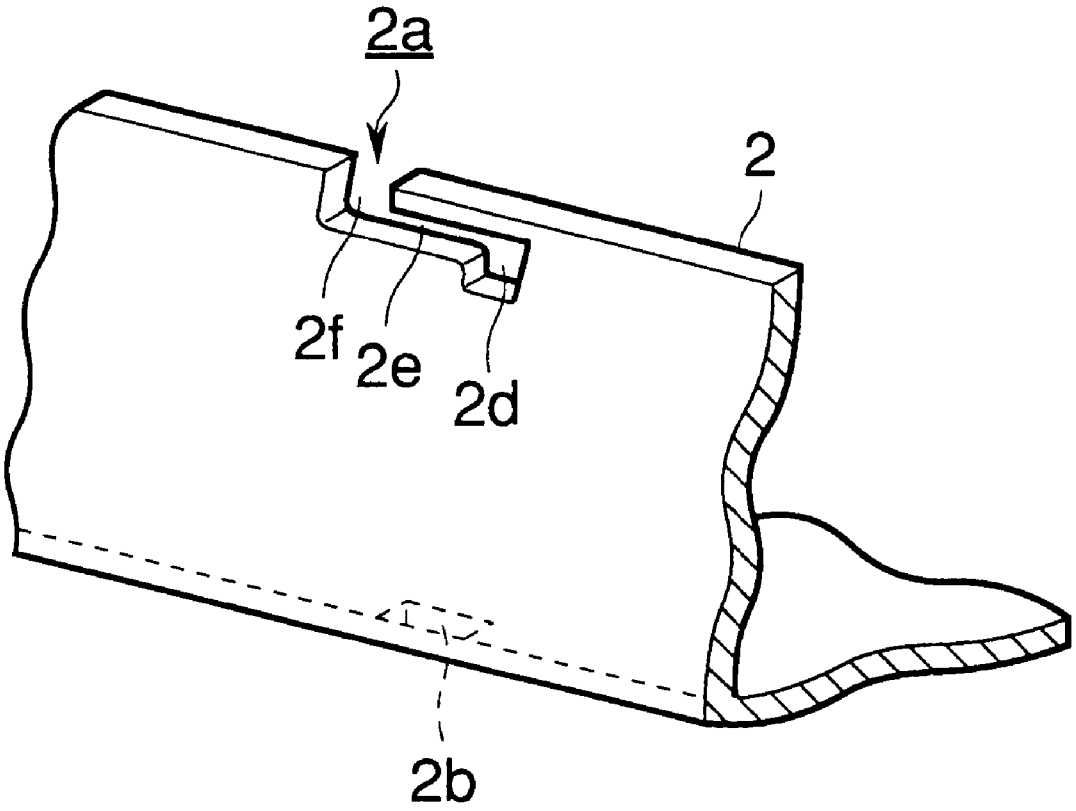
FIG. 4 is a fragmentary perspective view of the base 2.

FIG. 4 is a fragmentary perspective view of the base 2.

Figure 5:
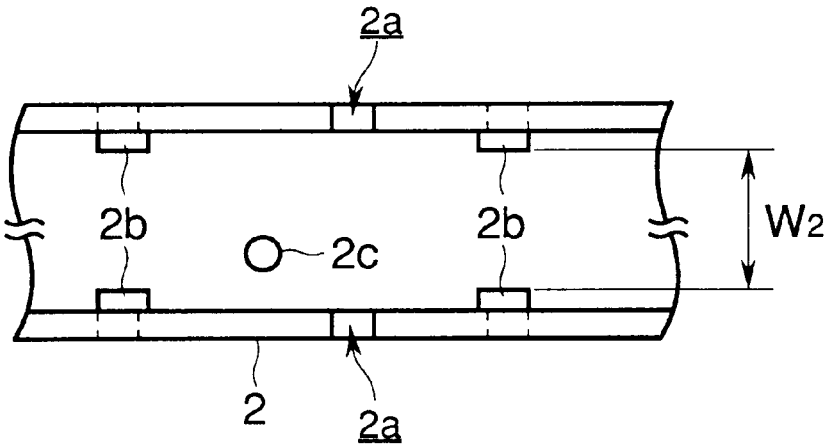
FIG. 5 is a partial top view of the base 2 as seen in a direction shown by an arrow A of FIG. 1.

FIG. 5 is a partial top view of the base 2 as seen in a direction shown by arrow A of FIG. 1.

The base 2 is made of a metal material using a metal mold. The base 2 has two opposing rigid walls 2A and 2B and each wall is formed with a plurality of cutouts 2*a* therein between which the SLA holder 3 is inserted. Each cutout has a long opening 2*e* and short openings 2*f* and 2*d* which extend opposite from the long opening 2*e* at longitudinal ends of the long opening 2*e*.

The base 2 is also formed with a plurality of holes 2*b* in its bottom and positioning holes 2*c* that facilitates positioning of the printed circuit board 7 with respect to the base 2. The cutouts 2*a* and holes 2*b* and 2*c* are formed by, for example, pressing. The two opposing holes 2*b* are spaced apart by a predetermined distance W2 so that the SLA holder 3 is accurately placed in position when the SLA holder 3 is assembled to the base 2. There are provided a plurality of spring members 3*d* along the wall 3*f*.

Figure 6:
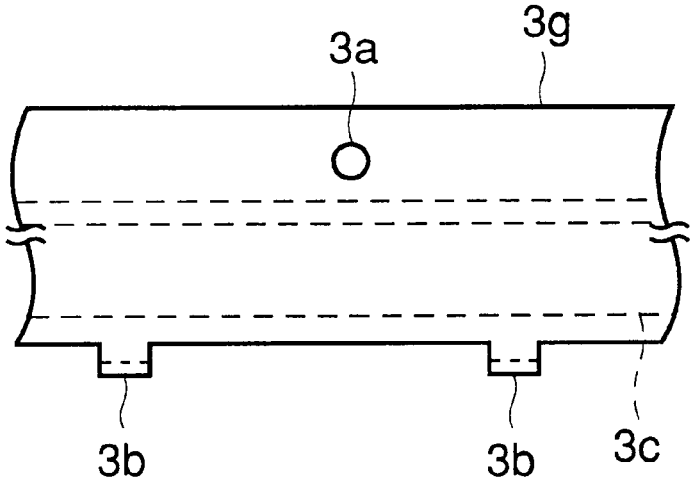
FIG. 6 is a partial side view of the SLA holder.

FIG. 6 is a partial side view of the SLA holder 3 as seen in the direction shown by arrow D.

The SLA holder 3 is molded from plastics in one-piece construction including two opposing walls 3*f* and 3*g*. The SLA holder 3 has projections 3*a* outwardly extending from the opposing walls 3*f* and 3*g*, and a plurality of projections 3*b* downwardly extending from the lower ends of the opposed walls 3*f* and 3*g*. The projections 3*b* extend into the holes 2*b* formed in the base 2 when SLA holder 3 is assembled to the base 2 with the projections 3*a* guided through the openings 2*f* and 2*e* into openings 2*d*. Each of the projections 3*b* has a beveled surface 3*j* that facilitates insertion of the projections into the holes 2*b*. Each of the walls 3*g* and 3*f* is formed with a stepped portion 3*c* at its lower end. The projections 3*b* extending into the holes 2*b* play an important role in that the inclination of the walls 3*f* and 3*g* toward each other is corrected, thereby the problem due to the inclination of the SLA 4 in the conventional art is solved.

The assembly operation of the LED head 1 will be described.

Referring again to FIG. 1, the LED array unit 5 is first assembled to the bottom of the base 2 with the positioning projections 7*a* fitting into the holes 2*c* in the base 2. Then, the SLA holder 3 is assembled into the base 2. When the projections 3*b* fit into the holes 2*b* and the projections 3*a* engage the short openings 2*d,* the SLA holder 3 is accurately placed in position. The stepped portions 3*c* of the SLA holder 3 abut the top surface of the printed circuit board 7, the SLA holder 3 firmly holding down the printed circuit board 7. Then, the SLA 4 is pushed into a space 1*a* in a direction shown by arrow A till the SLA 4 abuts the stepped portions 3*h*. The spring members 3*d* engage the SLA 4 to urge the SLA 4 against the wall surface 3*e,* thereby holding the SLA 4 firmly in position.

Figure 7:
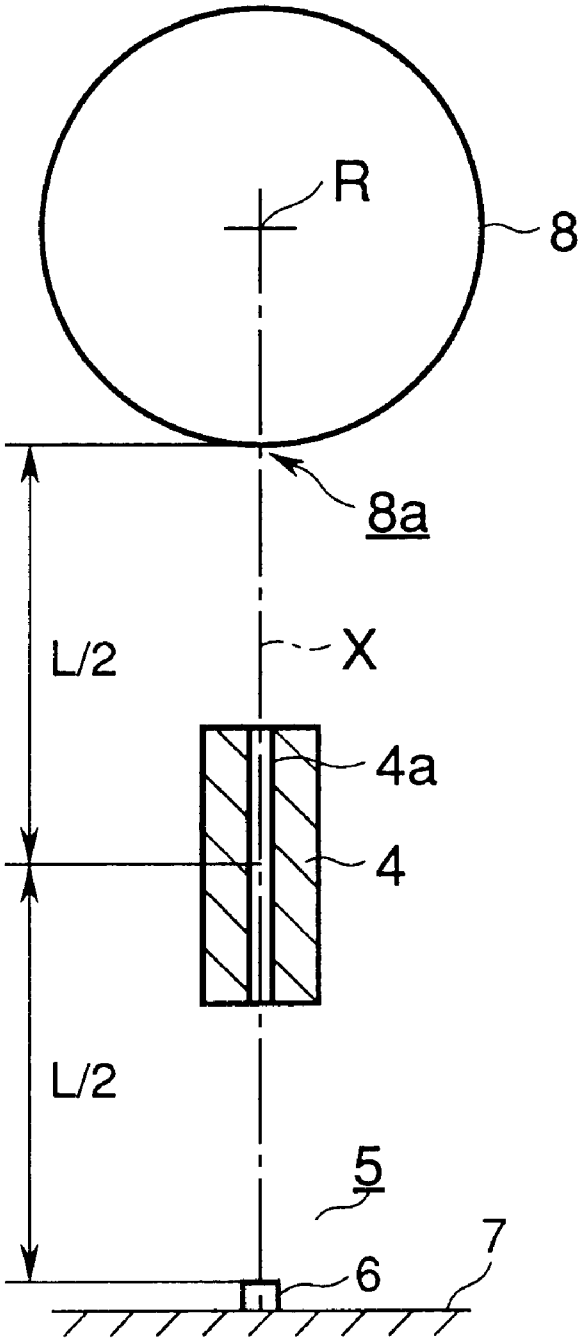
FIG. 7 illustrates the positional relation among the SLA, LED array, and a photoconductive drum.

FIG. 7 illustrates the positional relation among the SLA 4, LED array 6, and a photoconductive drum 8.

Each of LEDs in the LED arrays 6 lies on the optical axis X of the lens assembly 4, so that images of the LEDs are formed in the same plane as the LEDs and the optical axis of the lens assembly are located.

After the SLA 4 has been placed in position, the SLA 4 is permanently fixed to the SLA holder 3 by applying, for example, an adhesive 3*i* as shown by a thick solid line in FIG. 1.

Alternatively, the SLA 4 may be first sandwiched between the walls 3*g* and 3*f* and then the entire assembly may be assembled into the base 2. The assembled LED head 1 is then mounted to an electrophotographic printer 8 (FIG. 7) so that each of the LEDs on the circuit board 7 and a point on the surface of the photoconductive drum 8 form a pair of conjugate points with respect to the corresponding rod lens in the SLA 4. The SLA 4 is positioned midway between the LED array 6 and the photoconductive drum 8 so that the image of the LEDs are formed on the surface 8*a* of the photoconductive drum 8. Upon accurately holding the LED head 1 with respect to the the photoconductive drum 8, the LEDs in the LED arrays 6, the axis R of rotation of the photoconductive drum 8, and the optical axis X of the SLA 4 are in the same plane.

The width W1 of the circuit board 7 is somewhat shorter than the distance W2.

Once the SLA holder 3 is placed in position in the base 2 with the projections 3*b* extending through the holes 2*b,* the SLA holder 3 is limited its lateral movement and the entire wall surface 3*m* of the SLA holder is in close contact with the inner wall surface 2*i* of the base 2.

The base 2 is usually formed by pressing using a metal mold. The metal mold used to manufacture the conventional base may be used if a modification is made to the metal mold in order to form holes 2*b* in the base 2. Thus, the invention can be practiced for improved print quality without a significant increase in manufacturing cost.

In the first embodiment, the SLA holder 3 is placed in position relative to the base 2 using the projections 3*a* and projections 3*b* formed on the SLA holder 3. Alternatively, the base 2 may be formed with projections similar to the projections 3*a* and 3*b* and the SLA holder 3 may be formed with cutouts and holes into which the projections are fit.

Instead of forming projections, holes, and cutouts in the SLA holder 3, the SLA holder 3 may be formed with hook-like members which grasps the base 2 to place the SLA holder 3 in position.

In this embodiment, the SLA 4 is mounted to the SLA holder 3 before the SLA holder 3 is assembled to the base 2. However, the SLA 4 may be inserted into the SLA holder 3 after the SLA holder 3 has been assembled into the base 2.

Second embodiment

Figure 8:
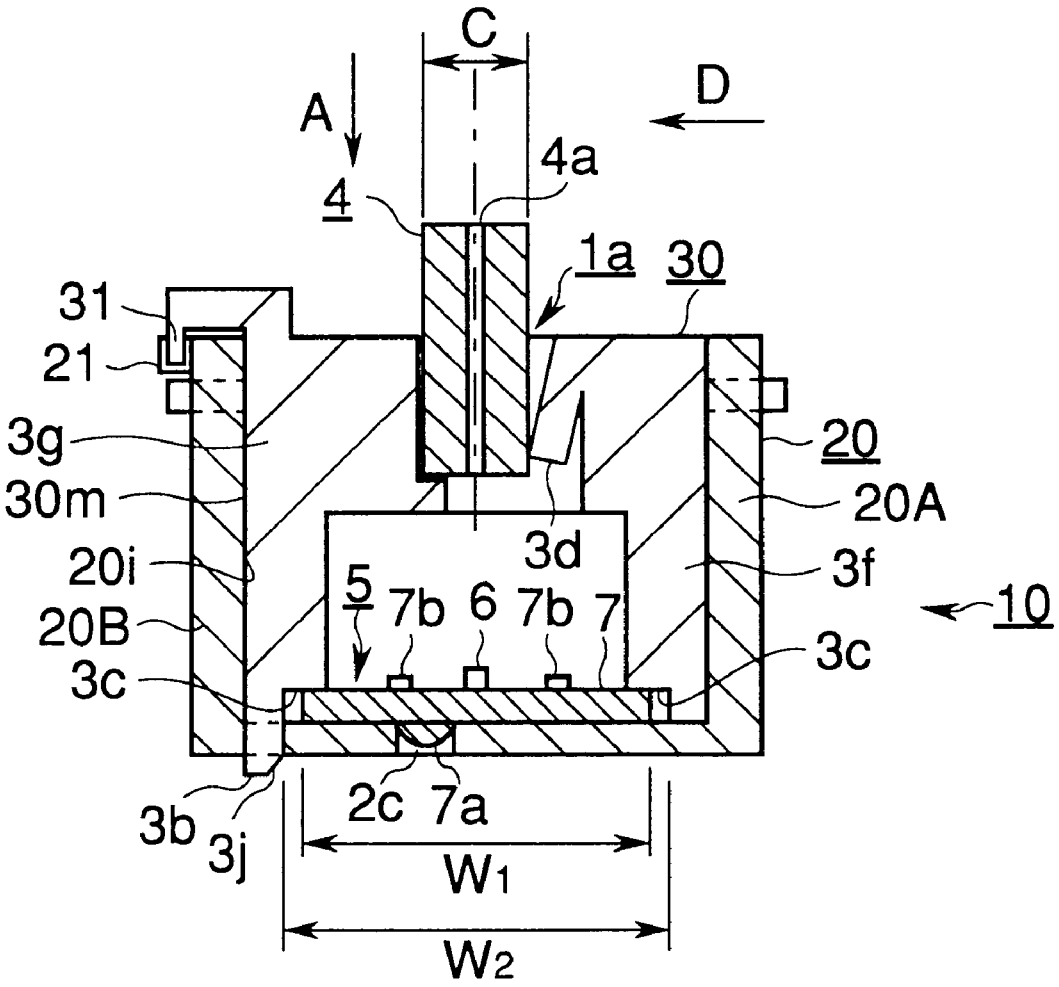
FIG. 8 is a cross-sectional view of an LED head 10 of a second embodiment, which is a modification of the first embodiment.

FIG. 8 is a cross-sectional view of an LED head 10 which is a modification of the first embodiment.

The SLA holder 30 supports the SLA 4 in position just as in the first embodiment. The SLA holder 30 is formed with hooks 31 on the upper end of the wall 30*g* and downward projections 3*b* at the lower end of the wall 30*g*. The hooks 31 grasp the base 20. A side wall 20B of the base 20 has a hook receiving portion 21 which receives and firmly holds the hook 31 of the SLA holder 30 therein when the SLA holder 30 is inserted into the base 20. The base 20 is formed with a plurality of holes 2*b* which receives the projections 3*b*.

Figure 9:
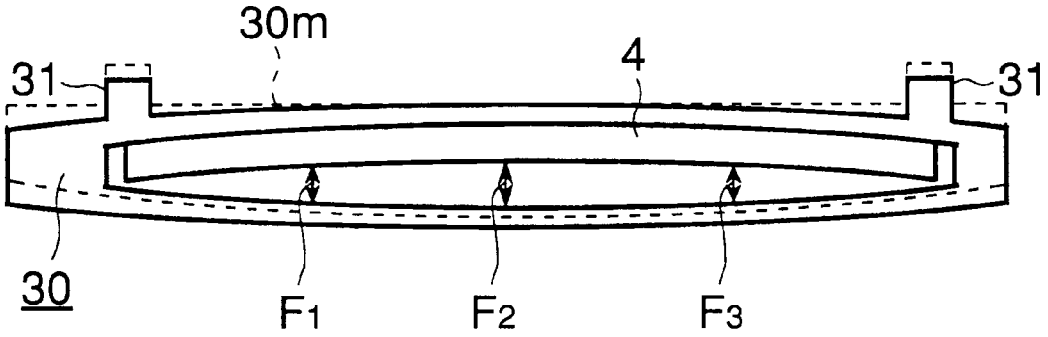
FIG. 9 is a top view of the SLA and SLA holder of the second embodiment.

FIG. 9 is a top view of the SLA holder 30 according to the second embodiment. The SLA holder 30 longitudinally extends and has two hooks 31 at lateral one side of a longitudinally extending body thereof. When the SLA 4 is inserted into the SLA holder 30 before the SLA 30 is assembled to the base 2, the SLA holder and the SLA 4 are deformed as depicted by solid lines.

Other construction is the same as that of the first embodiment and the description thereof have been omitted.

The assembly operation of the second embodiment will be described with reference to FIG. 8.

The LED array unit 5 is assembled to the base 20 with the positioning projections 7*a* fitting into the holes 2*c*.

Then, the SLA holder 30 is mounted to the base 20. At this time, the hooks 31 grasp the side walls of the base 20 while at the same time the free ends of the hooks 31 are received in the hook-receiving portions 21, thereby positioning the SLA holder 30 in place with respect to the base 20. Then, the SLA 4 is inserted between the two opposing walls 30*f* and 30*g* of the SLA holder 30. It is to be noted that the entire wall surface 30*m* of the wall 30*g* is in contact with the inner wall surface 20*i* of the base 20, therefore, the shapes of the SLA holder 30 and the SLA 4 are those depicted by dotted lines in FIG. 9. The entire wall surface 30*m* and the the SLA 4 are no longer curved but flat and straight.

Just as in the first embodiment, when the assembled LED head 10 is mounted into an electrophotographic printer, not shown, the distance between the LED array 6 and the photoconductive drum 8 is equal to the conjugate distance L and the SLA 4 is at the center of the conjugate distance L (FIG. 7). When the LED head 10 illuminates the surface of the photoconductive drum 8, the LEDs of the arrays 6, the images of the LEDs formed at the point 8*a,* the optical axis of the SLA 4, and the axis R of rotation of the photoconductive drum 8 are in the same plane.

In the second embodiment, mounting the SLA holder 30 to the base 20 with the free ends of the hooks 31 received in the receiving portions 21, permits the SLA holder 30 to be positioned with respect to the base 20 and limits the lateral movement of the SLA holder 30. The walls 30*g* and 30*f* are forcibly held at a few locations by the hook-to-groove fitting engagement against the flat inner surfaces of the rigid walls 20A and 20B of the base 20. Therefore, the construction is effective in firmly holding the SLA holder 30 in the base 20 prior to the insertion of the SLA 4.

The base 20 may be of a metal material by pressing and a metal mold used for manufacturing the base of the conventional LED head may be used, if some modification is made to it in order to add the hook receiving portions 21 and holes 2*b*. The SLA holder 30 is molded from plastics. The metal mold used for manufacturing the SLA holder of the conventional LED head may be used, if some modification is made to it in order to add the hooks 31. Thus, the invention can be practiced for improved print quality without a significant increase in manufacturing cost.

In the aforementioned second embodiment, the SLA holder 30 is formed with hooks 31 thereon. Alternatively, the base 20 may be formed with hooks, and the hook receiving portions may be formed on the SLA holder 30.

Third embodiment

Figure 10:
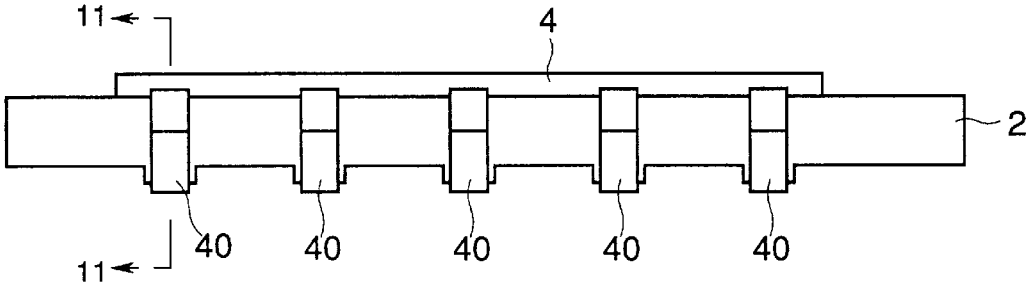
FIG. 10 is a side view of an LED head according to a third embodiment of the invention.

FIG. 10 is a side view of an LED head according to a third embodiment of the invention.

Figure 11:
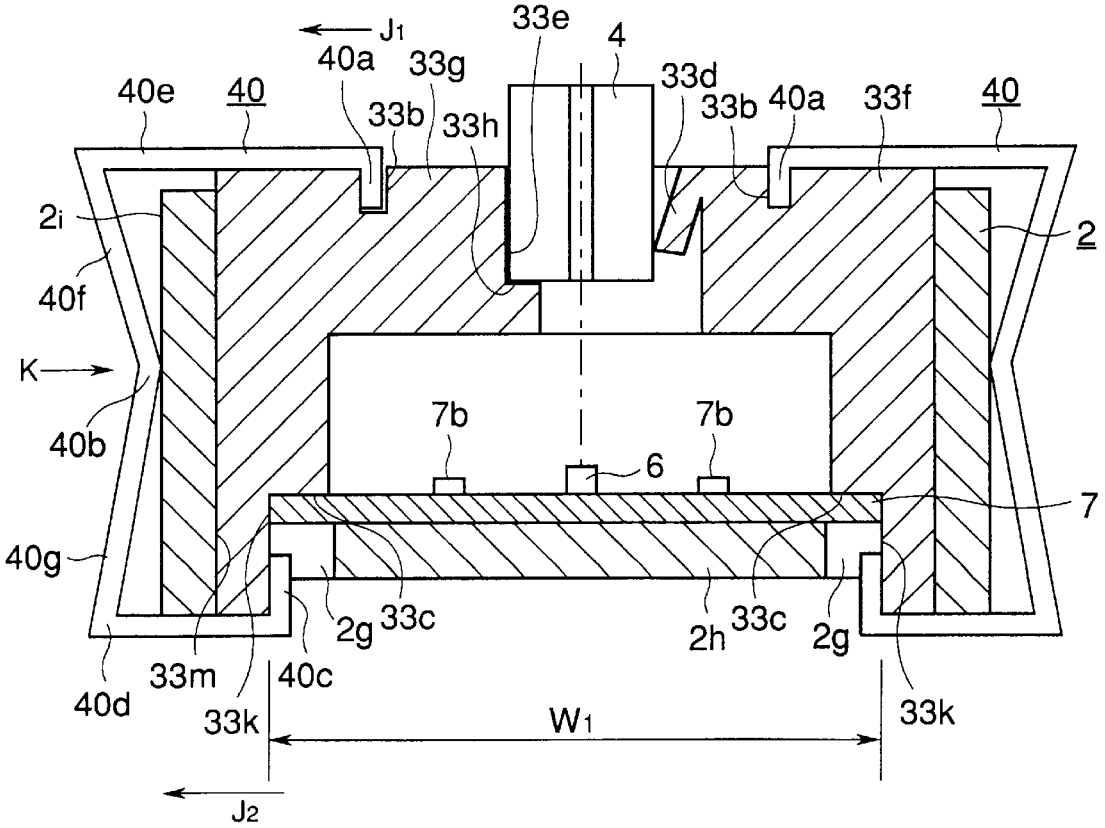
FIG. 11 is a cross-sectional view taken along lines 11—11 of FIG. 10.

FIG. 11 is a cross-sectional view taken along lines 11—11 of FIG. 10.

Figure 13:
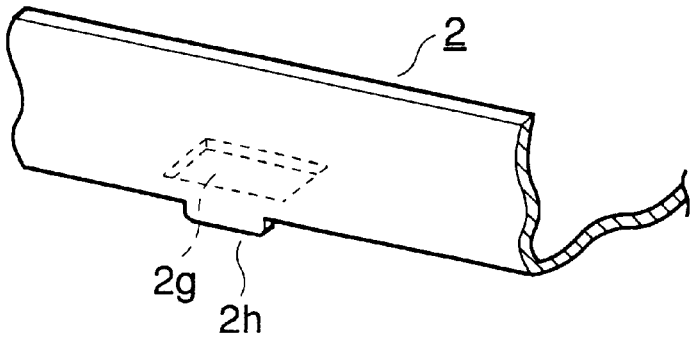
FIG. 13 is a fragmentary perspective view of the base of the third embodiment.

FIG. 13 is a fragmentary perspective view of the base 2.

Figure 14:
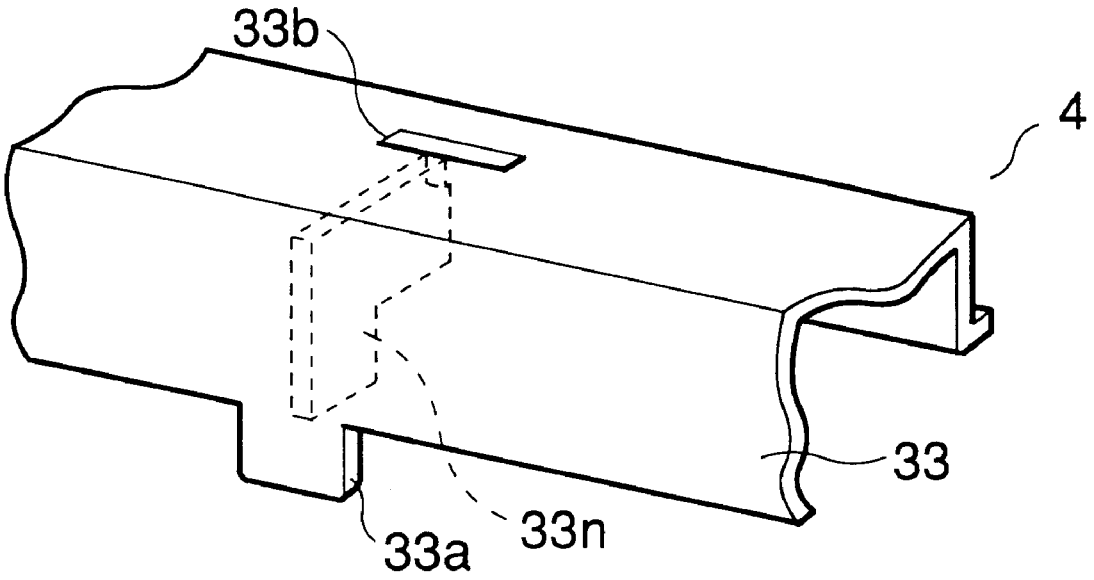
FIG. 14 is a fragmentary perspective view of the SLA holder.

FIG. 14 is a fragmentary perspective view of the SLA holder 33.

The LED head has clamps 40. A total of 10 clamps are arranged at predetermined intervals in a longitudinal direction of a base 2, first five clamps 40 being arranged on one side of the base 2 and second five clamps 40 being on the other side. The first and second clamps 40 are arranged in a mirror image as shown in FIG. 11.

A SLA 4 in received at a stepped portion 33*h* of an SLA holder 33 and is urged in a direction shown by an arrow J by the spring members 33*d* against the wall surface 33*e*. An optical axis of the SLA 4, shown in a dot-dash line, is normal to a printed circuit board 7 and is in line with the LEDs of LED arrays 6 mounted on the circuit board 7. The printed circuit board 7 has a width W1 and is received by stepped portion defined by surfaces 33*c* and 33*k* at left and right ends. The SLA 4 and printed circuit board 7 are assembled to the SLA holder 33 with the printed circuit board 7 friction-fitted to the SLA holder 33.

Figure 12:
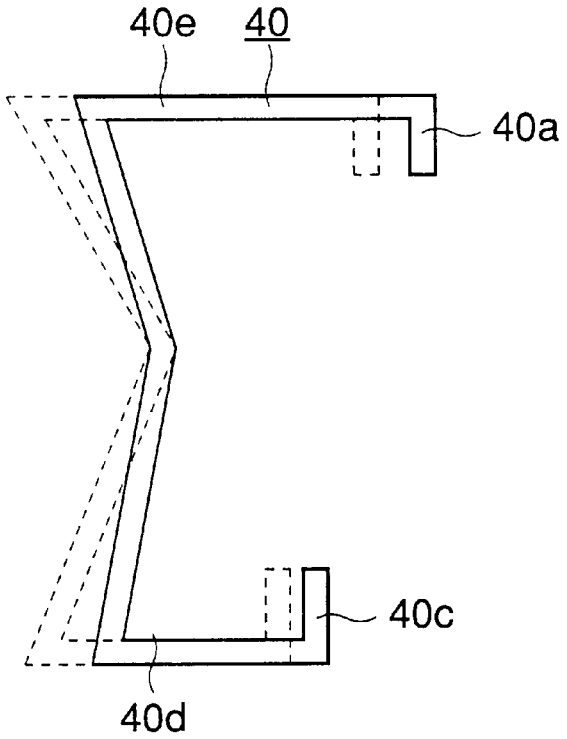
FIG. 12 illustrates the clamp of the third embodiment.

FIG. 12 illustrates the clamp 40, the solid line showing the shape of the clamp 40 when assembled to the LED head and the dotted line showing the shape before the clamp 40 is assembled to the LED head. The clamp 40 is formed of a resilient metal material and has a generally U-shaped cross-section. The cross section has two opposing members 40*e* and 40*d* extending substantially parallel to each other and an intermediate member (40*f* and 40*g*) between the two opposing members 40*e* and 40*d*. The opposing members 40*e* and 40*d* are bent toward each other to form hooks at their free ends 40*a* and 40*c*. The intermediate member is a somewhat kinked portion in its middle which forms an abutting portion 40*b*.

Referring again to FIG. 11, the hook-like end 40*a* of the clamp 40 enters a recess 33*b* formed in the holder engages and the hook-like end 40*c* extends into a hole 2*g* (FIG. 13) of the base and engages inner surface of a projection 2*h* (FIG. 13) of the base 2. The SLA holder has a plurality of ribs 33*n* (FIG. 14). Upon assembling the clamp 40 to the LED head, the clamp 40 engages the SLA holder 33 at the free ends 40*a* and 40*c* and the abutting portion 40*b* in such a way that free ends 40*a* and 40*c* hold the wall 330*g* and pulls in directions shown by arrows J1 and J2 and the middle portion 40*b* pushing the base 2 in a direction shown by arrow K. In this manner, the outer vertical wall surface 33*m* is firmly urged against the inner wall surface 2*i* of the base 2 so that the substantially entire wall surface 33*m* is in intimate contact with the inner surface 2*i* of the base. The opposing clamp 40 is assembled in the same manner. Upon assembling all the clamps 40 to the LED head, the SLA 4 is positioned in place with respect to LED arrays 6.

Modification of third embodiment

Figure 15:
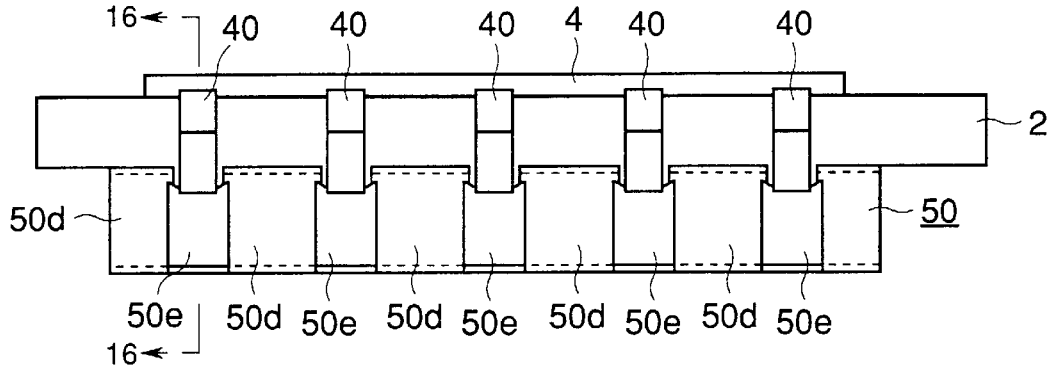
FIG. 15 is a side view of an LED head according to a third embodiment of the invention.

FIG. 15 is a side view of an LED head according to a third embodiment of the invention.

Figure 16:
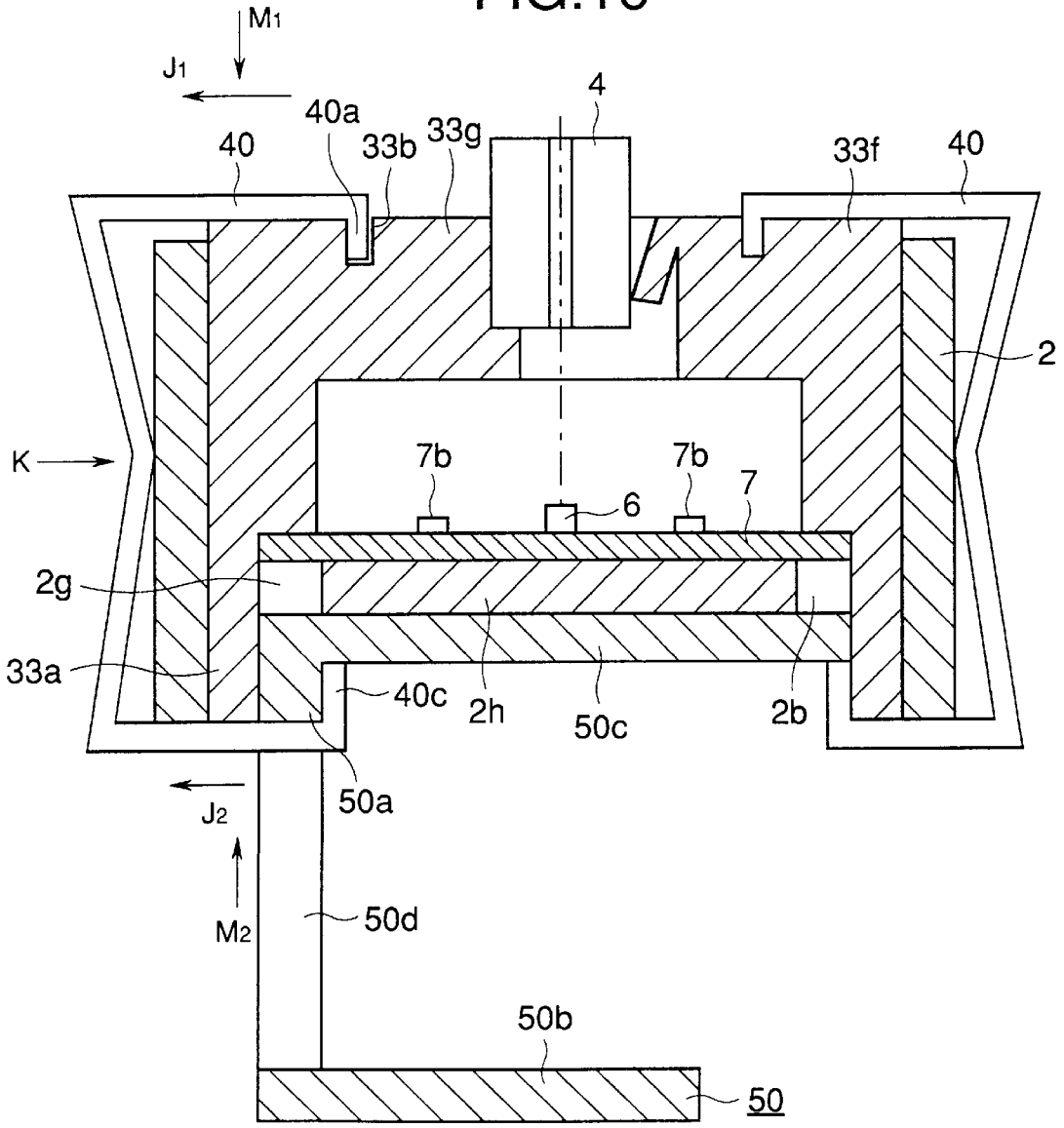
FIG. 16 is a cross-sectional view taken along lines 16—16.
Figure 17:
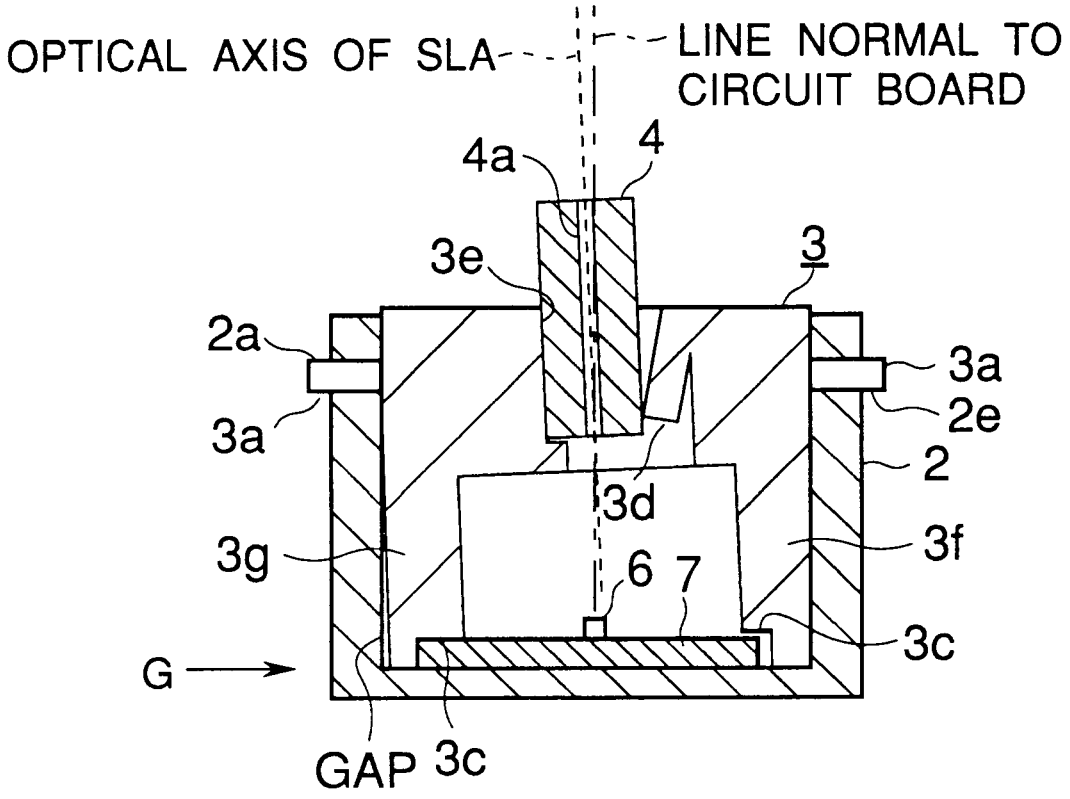
FIG.17 CONVENTIONAL ART
FIG. 17 is a cross-sectional view of a conventional LED head.
Figure 18:
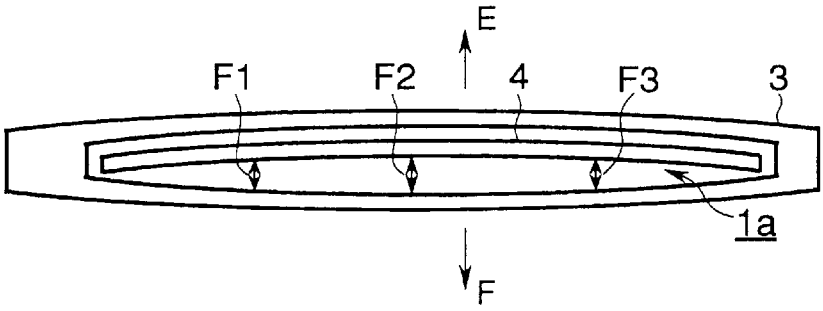
FIG.18 CONVENTIONAL ART
FIG. 18 is a top view of the SLA and SLA holder of the conventional LED head.
Figure 19:
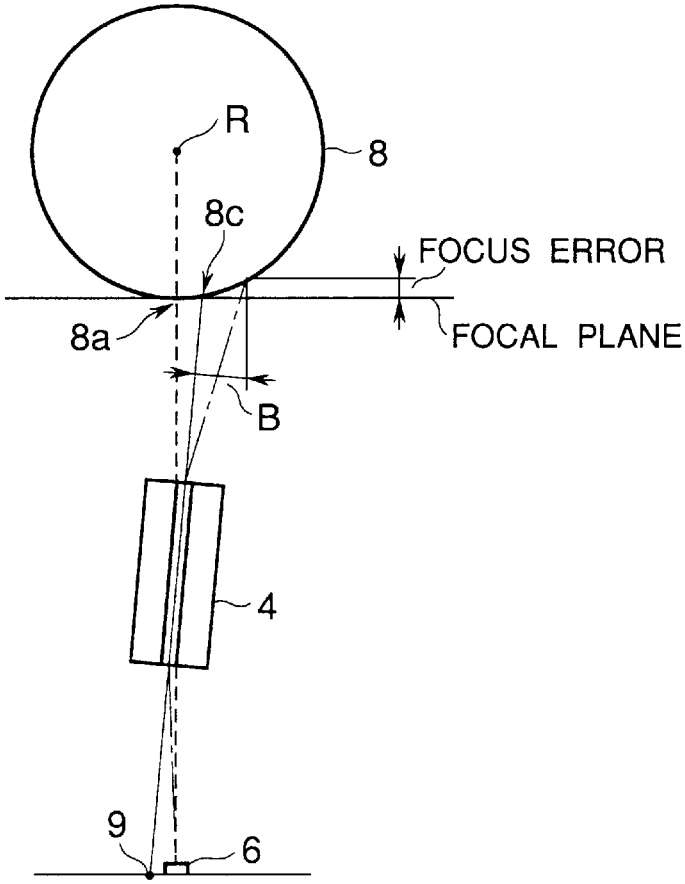
FIG.19 CONVENTIONAL ART
FIG. 19 shows the SLA mounted when the SLA holder is positioned using the width W1 of the printed circuit board as a reference.

FIG. 16 is a cross-sectional view taken along lines 16—16 of FIG. 15.

The LED circuit board 7 has many LED arrays 6 over as long a distance as the width of a page of a print medium. A large number of LED arrays are energized when an image having a relatively high overall density is to be printed. Therefore, the LED arrays generate a large amount of heat. For example, an LED head for a resolution of 600 dpi has 4992 light emitting elements aligned in a longitudinal direction (perpendicular to the page of FIG. 16). Each light emitting element consumes a current of 3 mA. Even if the light emitting elements are divided into two longitudinally extending groups and energized in turn, a maximum power consumption of the LED head is about 37 W at a supply voltage of 5 V.

Therefore, some kind of heat dissipating means is necessary. In the modification, a heat sink 50 is assembled to the LED head. The heat sink 50 is generally U-shaped having a opposing walls 50*c* and 50*b* with a bottom 50*d* between the walls 50*c* and 50*b*. The bottom 50*d* is formed with holes 50*e* at predetermined intervals. The heat generated by the LED arrays 6 is transferred through the circuit board 7 and base 2 to the wall 50*c* of the heat sink 50.

The LED circuit board 7, SLA holder 33, base 2, and SLA 4 are assembled in the same manner as the second embodiment. Upon assembling the clamp 40 to the LED head, the clamp 40 engages the SLA holder 33 at the free ends 40*a* and 40*c* and a middle portion 40*b* in such a way that free ends 40*a* and 40*c* hold the wall 33*g* and pulls in directions shown by arrows J1 and J2 and the middle portion 40*b* pushing the base 2 in a direction shown by arrow K. It is to be noted that the free ends 40*a* and 40*c* also urge the wall 33*g*, LED circuit board 7, base 2*h*, and wall 50*c* of the heat sink in directions shown by arrows M1 and M2 to hold them together. In this manner, the outer vertical wall surface 33*m* is firmly urged against the inner wall surface 2*i* of the base 2 while also holding the heat sink in intimate contact with the base bottom 2*h* for good heat dissipation. The opposing clamp 40 is assembled in the same manner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An LED head which illuminates a surface of a photoconductive body, comprising:

a circuit board on which LED arrays are mounted thereon in a row;

a lens assembly having an optical axis and focusing light emitted from the LED arrays on the surface of the photoconductive body;

a holder having a first wall with a first surface and a first reference surface opposing the first surface, the first surface supporting said lens assembly mounted thereto, the first reference surface extending in a first plane parallel to the row and the optical axis, said first wall having a first engagement portion that projects from the first wall in a first direction parallel to the optical axis, said first engagement portion having a surface that lies in the first plane; and a base housing said circuit board and said holder therein, said base having a second engagement portion and a second reference surface that lies in the first plane;

wherein when said holder is assembled into said base with the first engagement portion engaging the second engagement portion, the second reference surface is brought into intimate contact with the first reference surface and the optical axis is positioned with respect to the LED arrays.

2. The LED head according to claim 1, wherein said first engagement portion is at least one projection that projects from said first wall and said second engagement portion is at least one hole formed in a bottom of said base, the projection fitting into the hole.

3. The LED head according to claim 2, wherein said base includes at least one second wall having the second reference surface, and the first wall of said holder includes at least hook formed on said holder remote from the projection, the hook grasping the second wall so that the first reference surface is in intimate contact with the second reference surface.

4. The LED head according to claim 2 further including an urging member that urges said lens assembly against the first surface, whereby said urging member and said first and second engagement portions cooperate to bring said the first reference surface into intimate contact with the second reference surface.

5. An LED head which illuminates a surface of a photoconductive body, comprising:

a circuit board on which LED arrays are mounted thereon in a row;

a lens assembly, having an optical axis and focusing light emitted from the LED arrays on the surface of the photoconductive body;

a holder, having a first wall with a first surface and a first reference surface opposing the first surface, the first surface supporting said lens assembly mounted thereto, the first reference surface extending in a first plane parallel to the row and the optical axis, said first wall having a first engagement portion that projects from the first wall in a first direction parallel to the optical axis, and a second engagement portion that engages said circuit board, said first engagement portion having a surface that lies in the first plane; and a base, housing said circuit board and said holder therein, said base having a third engagement portion, a second reference surface that lies in the first plane, and a third reference surface on which said circuit board is supported, said base being more rigid than said circuit board and said holder;

wherein when said holder is assembled into said base with the first engagement portion engaging the third engagement portion, the second reference surface is brought into intimate contact with the first reference surface, the optical axis is positioned with respect to the LED arrays, and the second engagement portion engages said printed circuit board to firmly hold down the printed circuit board against the third reference surface.

* * * * *